US012679601B2

(12) United States Patent
Bruns et al.

(10) Patent No.: US 12,679,601 B2
(45) Date of Patent: Jul. 14, 2026

(54) METAL DETECTABLE PLASTIC BAG AND METHODS OF MAKING AND USE

(71) Applicant: Nasco Sampling LLC, Pleasant Prarie, WI (US)

(72) Inventors: Nick Bruns, Madison, WI (US); Greg Hood, Dublin, OH (US)

(73) Assignee: Nasco Sampling LLC, Pleasant Praine, WI (US)

( * ) Notice: Subject to any disclaimer, the term of this patent is extended or adjusted under 35 U.S.C. 154(b) by 346 days.

(21) Appl. No.: 18/348,007

(22) Filed: Jul. 6, 2023

(65) Prior Publication Data

US 2024/0017888 A1 Jan. 18, 2024

Related U.S. Application Data

(60) Provisional application No. 63/367,769, filed on Jul. 6, 2022.

(51) Int. Cl.

| | |
|---|---|
| ***B65D 33/00*** | (2006.01) |
| ***B65D 33/30*** | (2006.01) |
| ***B65D 33/34*** | (2006.01) |
| ***B65D 65/40*** | (2006.01) |

(52) U.S. Cl.
CPC ..... *B65D 33/34* (2013.01); *B65D 33/004* (2013.01); *B65D 33/30* (2013.01); *B65D 65/40* (2013.01); *B65D 2203/12* (2013.01)

(58) Field of Classification Search
CPC ..... B65D 33/30; B65D 33/34; B65D 33/004
USPC ..... 383/203, 204, 89, 90, 91
See application file for complete search history.

(56) References Cited

U.S. PATENT DOCUMENTS

| | | | | |
|---|---|---|---|---|
| 3,311,288 | A * | 3/1967 | Lemelson | B65D 63/10 383/905 |
| 5,180,229 | A * | 1/1993 | Niemeyer | B65D 33/30 383/91 |
| 5,215,797 | A * | 6/1993 | Larsen | B65D 33/1691 383/905 |
| 2005/0028924 | A1* | 2/2005 | Ward, Jr. | B65D 33/30 156/267 |
| 2019/0040226 | A1* | 2/2019 | Aga | C01G 49/0036 |
| 2019/0185216 | A1* | 6/2019 | Trollen | B44D 3/125 |

* cited by examiner

*Primary Examiner* — Nathan J Newhouse
*Assistant Examiner* — Nina K Attel
(74) *Attorney, Agent, or Firm* — Perman & Green, LLP

(57) ABSTRACT

Provided are metal detectable plastic bags, method of making and methods of using such bags for preventing product contamination when used to collect and retain samples of product. The metal detectable plastic bag includes a flexible body including an opposed front wall and back wall sealed together around the periphery of the walls to form an internal collection space including two side seal areas, a top seal area and a bottom seal area, a bag opening mechanism located proximate a top edge of the flexible body and below the top seal area. The bag opening mechanism includes one or more perforations, scores or cuts in the one or two side seal areas and optionally the front and back wall to form a removable tear strip. At least a portion of the removable tear strip is surface printed with a metallic based ink or surface coated with a metallic based coating.

41 Claims, 1 Drawing Sheet

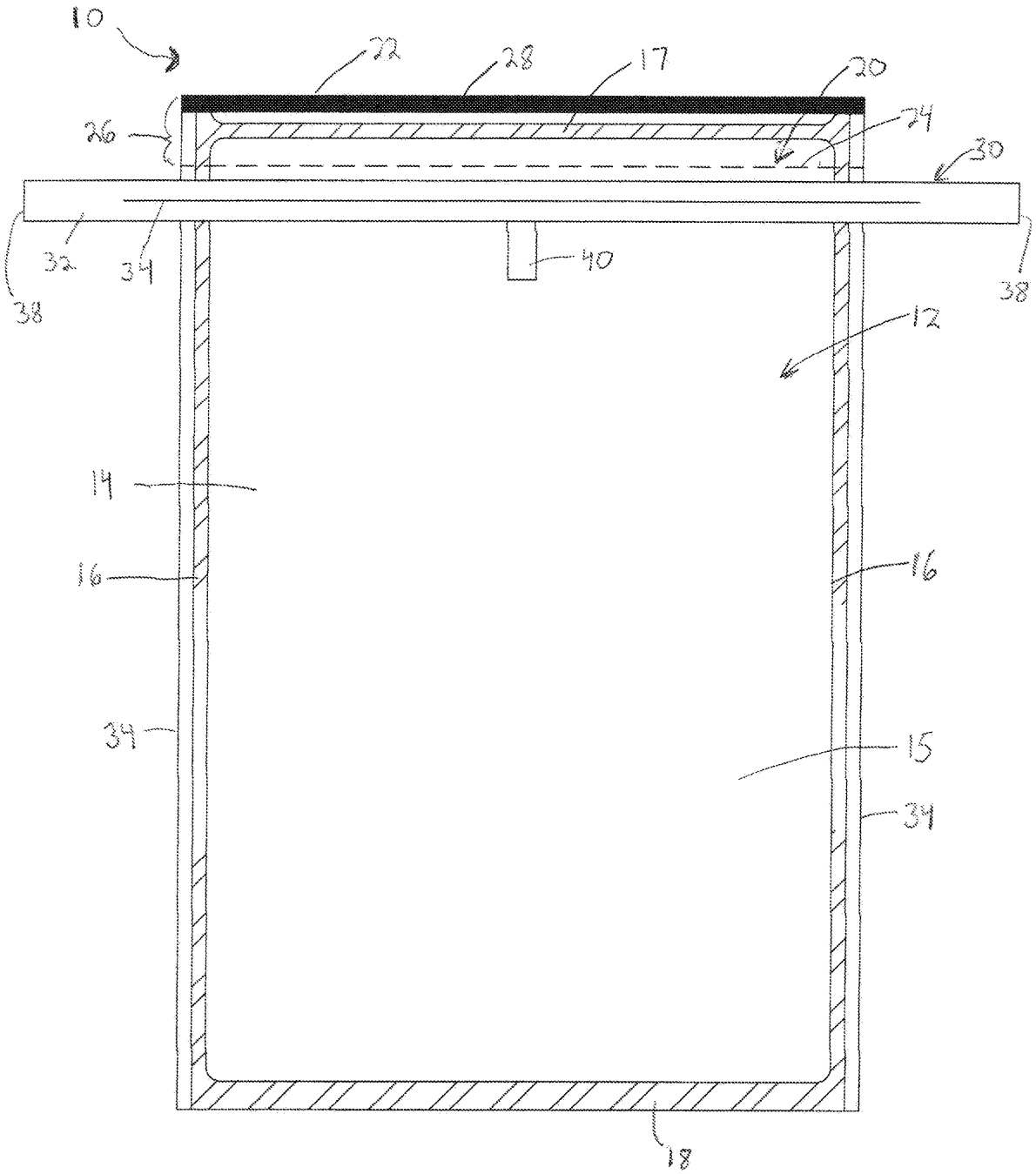
10
22
28
17
20
26
24
30
32
34
40
38
38
12
14
16
16
34
15
34
18

METAL DETECTABLE PLASTIC BAG AND METHODS OF MAKING AND USE

CROSS-REFERENCE TO RELATED APPLICATIONS

This is a non-provisional application that claims priority to U.S. Provisional Application No. 63/367,769 filed on Jul. 6, 2022, herein incorporated by reference in its entirety.

FIELD

The present disclosure relates to the field of plastic bags. It more particularly relates to plastics bags that are detectable through metal detectors and methods of making and using such bags, which are particularly useful as sample or product collection bags.

BACKGROUND

Plastics bags have a wide variety of uses for packaging and storing various materials, including, but not limited to, food and beverage items, pharmaceuticals, health and beauty items and lawn and garden items. These plastic bags are used to store a wide array of components including, but not limited to, liquids, dry solids, powdered solids and combination of liquid and solids. One deficiency with plastic sample collection bags used in the food and pharmaceutical industry for collecting samples of solid materials is that the tear strip or tape at the top of the bag, which is removed prior to filling the bag with a solid sample, could inadvertently makes its way into the food or pharmaceutical product stream and thus contaminate the product. Food and pharmaceutical production and packaging lines utilize metal detectors at various points of the process to detect and prevent product from being contaminated with metal containing contaminants. However, these metal detectors are not capable of detecting plastic sample collection bags or portions thereof, which poses a risk of contamination and hence, food and pharmaceutical where plastic could contaminate the product stream and packaged product. Hence, there is a need for plastic bags, and in particular, plastic sample collection bags that are detectable by metal detectors to improve food and pharmaceutical safety by eliminating the possibility of a portion or even an entire sample collection bag from contaminating product streams during manufacture and packaging.

Another deficiency with plastic sample collection bags used in the food and pharmaceutical industry is that outside surface of the bag tends to be slippery and difficult to grip due to the plastic film used to form the bag. In particular, the tear strip at the top of bag, which is removed prior to filling the bag with a solid sample, is often times slippery and hence difficult to handle in terms of not allowing for a good grip to easily remove it. Hence, there is a need for plastic bags, and in particular, plastic sample collection bags that provide for improved grip by the user to allow for greater ease in removing of the tear strip or tape at the top of the bag.

Based on the above identified deficiencies with plastic sample collection bags, there is a need for an improved bag which provides for a combination of improved grip properties and can also be detectable by a metal detector.

SUMMARY

One aspect of the present disclosure provides for a metal detectable plastic bag comprising a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, and wherein at least a portion of the removable tear strip is surface printed with a metallic based ink or surface coated with a metallic based coating.

Another aspect of the present disclosure provides for a metal detectable plastic bag comprising a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, a bag closing mechanism located proximate and below the removable tear strip, wherein the bag closing mechanism includes a first closure strip sealed to the front wall of the bag and a second closure strip sealed to the back wall of the bag, wherein the first and second closure strips are opposed to each other and extend beyond the side edges of the bag and, wherein the first closure strip and the second closure strip include a malleable wire embedded in the closure strip that traverses substantially the entire length of the closure strip or that traverses a majority of the length of the closure strip, wherein the malleable wire is selected from the group consisting of aluminum, bronze, copper, nickel, cobalt, brass, copper-zinc alloys, zinc, and iron based alloys, and one or more pull tabs affixed to the front wall, the back wall or a combination, wherein the one or more pull tabs are located between the first closure strip and the front wall, between the second closure strip and the back wall, or a combination thereof, and wherein at least a portion of the removable tear strip is surface printed with a metallic based ink or surface coated with a metallic based coating.

Yet another aspect of the present disclosure provides a method of making a metal detectable plastic bag comprising the steps of: providing a plastic bag comprising a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, and surface printing or coating on at least a portion of the removable tear strip of the plastic bag a metallic based ink or a metallic based coating.

Still yet further another aspect of the present disclosure provides for a method of making a metal detectable plastic bag comprising the steps of: providing a plastic bag comprising a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, a bag closing mechanism located proximate and below the removable tear strip, wherein the bag closing mechanism includes a first closure strip sealed to the front wall of the bag and a second closure strip sealed to the back wall of the bag, wherein the first and second closure strips are opposed to each other and extend beyond the side edges of the bag and, wherein the first closure strip and the second closure strip include a malleable wire embedded in the closure strip that traverses substantially the entire length of the closure strip or that traverses a majority of the length of the closure strip, wherein the malleable wire is selected from the group consisting of aluminum, bronze, copper, nickel, cobalt, brass, copper-zinc alloys, zinc, and iron based alloys, and one or more pull tabs affixed to the front wall, the back wall or a combination, wherein the one or more pull tabs are located between the first closure strip and the front wall, between the second closure strip and the back wall, or a combination thereof, and surface printing or coating on at least a portion of the removable tear strip of the plastic bag a metallic based ink or a metallic based coating.

Still yet further another aspect of the present disclosure provides for a method of using a metal detectable plastic bag to collect and retain a product sample and eliminate product contamination comprising the steps of: providing plastic bag comprising a plastic bag comprising a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, and wherein at least a portion of the removable tear strip is surface printed with a metallic based ink or surface coated with a metallic based coating; removing the removable tear strip from the plastic bag; and filling the internal collection space with a product sample; and wherein the removable tear strip is detectable by a metal detector on a product production and packaging line to prevent product contamination.

Another still yet further aspect of the present disclosure provides for a method of using a metal detectable plastic bag to collect and retain a product sample and eliminate product contamination comprising the steps of: providing a plastic bag comprising a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, a bag closing mechanism located proximate and below the removable tear strip, wherein the bag closing mechanism includes a first closure strip sealed to the front wall of the bag and a second closure strip sealed to the back wall of the bag, wherein the first and second closure strips are opposed to each other and extend beyond the side edges of the bag and, wherein the first closure strip and the second closure strip include a malleable wire embedded in the closure strip that traverses substantially the entire length of the closure strip or that traverses a majority of the length of the closure strip, wherein the malleable wire is selected from the group consisting of aluminum, bronze, copper, nickel, cobalt, brass, copper-zinc alloys, zinc, and iron based alloys, and one or more pull tabs affixed to the front wall, the back wall or a combination, wherein the one or more pull tabs are located between the first closure strip and the front wall, between the second closure strip and the back wall, or a combination thereof, and wherein at least a portion of the removable tear strip is surface printed with a metallic based ink or surface coated with a metallic based coating; removing the removable tear strip from the plastic bag; filling the internal collection space with a product sample; and closing the bag including the product sample with the bag closing mechanism; and wherein the removable tear strip is detectable by a metal detector on a product production and packaging line to prevent product contamination.

BRIEF DESCRIPTION OF THE DRAWINGS

To assist those of ordinary skill in the relevant art in making and using the subject matter hereof, reference is made to the appended drawings, wherein:

FIG. 1 is a front elevation view of an exemplary metal detectable plastic bag for sample collection.

DETAILED DESCRIPTION

All numerical values within the detailed description and the claims herein are modified by "about" or "approximately" the indicated value, and take into account experimental error and variations that would be expected by a person having ordinary skill in the art. In the present application, the phrase "sealant areas" is synonymous with "sealed areas" or "seals" which is defined as an area or areas where two or more plastic films are bonded together either with heat or thermally (heat seal), with ultrasonic energy (ultrasonic seal), or with adhesive (adhesive seal).

Although the present invention will be described with reference to the embodiments shown in the drawings, it should be understood that the present exemplary embodiments can be used individually or in any suitable combination thereof. Although the aspects of the disclosed embodiments will be described with reference to the drawings, it should be understood that the aspects of the disclosed embodiment can be embodied in many alternate forms. In addition, any suitable size, shape or type of elements or materials could be used for the metal detectable plastic bags disclosed herein.

Overview

The metal detectable plastic bags of the instant disclosure provide the following non-limiting advantages relative to plastic bags that are not metal detectable: decreased risk of product contamination, increased product safety and security, increase ease of identifying foreign matter, and increased grip for ease of opening. The metal detectable plastics bags of the instant disclosure utilize a metallic marker as a component of the bag to make the bag or parts of the bag identifiable by a metal detector. In one form, the metallic marker is a metallic ink printed on the bag or a portion of the bag. In another form, the metallic marker is a metallic coating coated on the bag or a portion of the bag. These features make the metal detectable plastic bags of the instant disclosure particularly useful as product sampling or product collection bags used to collect and retain samples of product periodically during manufacturing operations. The metal detectable plastic bags of the instant disclosure may be made of any shape and size. The flexible body 12 of the bag 10 may be of a shape, including, but not limited to, rectangular, square, circular, oval, triangle, trapezoid, pentagon, hexagon, heptagon and octagon. In an advantageous form, the metal detectable plastic bags of the instant disclosure are of a rectangular shape with the length of the bag being greater than the width of the bag. The overall bag width may range from 1 to 20 inches, or 2 to 18 inches, or 3 to 15 inches, or 4 to 12 inches, or 5 to 10 inches, or 6 to 8 inches. The overall bag length may range from 3 to 40 inches, or 4 to 30 inches, or 5 to 20 inches, or 6 to 15 inches, or 7 to 10 inches, or 8 to 9 inches.

In one embodiment of the metal detectable plastic bag disclosed herein, the bag includes a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area. The bag also includes an opening mechanism comprising one or more perforations, scores or cuts in the one or two side seal areas and optionally the front and back wall to form a removable tear strip. At least a portion of the removable tear strip is surface printed with a metallic based ink or surface coated with a metallic based coating.

In another embodiment of the metal detectable plastic bag disclosed herein, the bag includes a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area. The bag also includes a bag opening mechanism located proximate a top edge of the flexible body and below the top seal area, which comprises one or more perforations, scores or cuts in the one or two side seal areas and optionally the front and back wall to form a removable tear strip. The bag also includes a bag closing mechanism located proximate and below the removable tear strip, which includes a first closure strip sealed to the front wall of the bag and a second closure strip sealed to the back wall of the bag, wherein the first and second closure strips are opposed to each other and extend beyond the side edges of the bag and which include a malleable wire embedded in the strips that traverses substantially the entire length of the closure strip or that traverses a majority of the length of the closure strip. The bag also includes one or more pull tabs affixed to the front wall, the back wall or a combination and are located between the first closure strip and the front wall, between the second closure strip and the back wall, or a combination thereof. At least a portion of the removable tear strip is surface printed with a metallic based ink or surface coated with a metallic based coating.

For each of these embodiments of the metal detectable plastic bag, the metallic based ink or surface coated with a metallic based coating applied to at least a portion of the removable tear strip makes the bag detectable by a metal detectable. In addition, after the bags disclosed herein are opened and the removable tear strip is separated from the remainder of the bag, the tear strip with metallic based ink or a metallic based coating may be identified by a metal detector on a product line to prevent the product from being inadvertently contaminated with the tear strip itself. This results in improved product cleanliness, safety and integrity by eliminating the possibility of the product being contaminated with the separated tear strip during manufacturing operations.

In another form of the metal detectable plastic bags disclosed herein, the bags may also optionally include a removable tear strip that provides a soft touch feature that improves the ability of the user to grip the removable tear strip and remove it from the bag in order to access the internal collection space. This feature is provided by surface printing the metallic based ink is printed on the removable tear strip at a density of at least 1.5 as measured by a reflection densitometer. It has been discovered that when the ink density on the removable tear strip is at least 1.5, a higher coefficient of friction and hence improved grip is provided for on the tear strip, which eases the ability to remove the tear strip from the bag in order to access the internal collection space relative to a comparable bag with a metallic based ink printed on the removable tear strip at a density of less than 1.4.

Metal Detectable Plastic Bag Embodiments and Methods of Making Such Bags

Referring to FIG. 1, an exemplary metal detectable plastic bag 10 of the instant disclosure is depicted. The metal detectable plastic bag 10 includes a flexible body 12 formed from a single or multi-layer polymeric film or multi-layer lamination. The flexible body 12 includes an opposed front wall 14 and back wall (not shown) sealed together around the periphery of the front wall 14 and the back wall (not shown) to form an internal collection space 15 including two side seal areas 16, a top seal area 17 and a bottom seal area 18.

Also included as part of the bag 10 is bag opening mechanism 20 located proximate a top edge 22 of the flexible body 12 and below the top seal area 17. The bag opening mechanism 20 includes a line of perforations, scores or cuts 24 in the two side seal areas 16 and the front wall 14 and the back wall (not shown) to form a removable tear strip 26. The line of perforations, scores or cuts 24 facilitate the tearing of the tear strip 26 from the top portion of the flexible body 12 of the bag 10. The line of perforations, lines or cuts 24 may be of various shapes and configurations, including, but not limited to, dotted lines, dashed lines or any other form that produces a segment or series of perforations in the two side seal areas 16, also optionally the front wall 14 and also optionally the back wall (not shown). The line of perforations, lines or cuts 24 may pass through the entire thickness of the two side seal areas 16, the front wall 14 and the back wall (not shown) or alternatively may just pass through a portion of the thickness, such as 30% of the thickness or less, or 50% of the thickness or less, or 80% of the thickness or less in order to improve the integrity of the bag opening mechanism 20 against contamination and improve its mechanical strength and integrity. The line of perforations, lines or cuts 24 are generally positioned from 0.1 to 1.8 inches, or 0.2 to 1.4 inches, or 0.3 to 1.2 inches, or 0.4 to 1 inch, or 0.5 to 0.8 inches from the top edge 22 of the flexible body 12 of the bag 10.

The removable tear strip 26 also includes a portion that is surface printed with a metallic based ink 28 or alternatively surface coated with a metallic based coating (not shown). The metallic based ink 28 may be of any color, however one particularly advantageous color to aid with visual detection of the removable tear strip 26 is blue. The removable tear strip 26 may be completely printed with a metallic based ink 28 or alternatively completely surface coated with a metallic based coating (not shown). Alternatively, 80% of the surface area or less, or 60% of the surface area or less, or 40% of the surface area or less, or 20% of the surface area or less of the removable tear strip 26 is surface printed with a metallic based ink 28 or surface coated with a metallic based coating (not shown). Generally, the greater the surface area of the removable tear strip 26 which is surface printed or coated with a metallic ink or coating, the more easily the tear strip 26 will be detected by a metal detector on a product line after its removal from the bag 10.

The exemplary metal detectable plastic bag 10 may also optionally include a bag closing mechanism 30 located proximate and below the removable tear strip 26. The bag closing mechanism 30 includes a first closure strip 32 sealed to the front wall 14 of the bag 10 and a second closure strip (not shown) sealed to the back wall (not shown) of the bag 10. The first closure strip 32 and second closure strip (not shown) are opposed to each other and extend beyond the side edges 34 of the bag 10. The overall length of the closure strips 32 exceed the width of the bag 10 with such excess ranging from 0.25 to 10 inches, or 0.5 to 8 inches, or 0.6 to 7 inches, or 0.7 to 6 inches, or 0.8 to 5 inches, or 1 to 4 inches, or 2 to 3 inches. The overall length of the closure strips 32 may range from 3 to 25 inches, or 4 to 20 inches, or 5 to 18 inches, or 6 to 15 inches, or 8 to 13 inches, or 9 to 12 inches. The overall width of the closure strips 32 may range from 0.1 to 2 inches, or 0.2 to 1 inch, or 0.3 to 0.9 inches, or 0.4 to 0.75 inches, or 0.5 to 0.6. The closure strips 32 are generally positioned from 0.2 to 2 inches, or 0.3 to 1.5 inches, or 0.4 to 1.2 inches, or 0.5 to 1 inch, or 0.6 to 0.8 inches from the top edge 22 of the flexible body 12 of the bag 10.

The first closure strip 32 and the second closure strip (not shown) may optionally include a malleable wire 36 embedded in each closure strip 32 that traverses substantially the entire length of the closure strip 32 or that traverses a majority of the length of the closure strip 32. In an advantageous form shown in FIG. 1, the malleable wire 36 embedded in each closure strip 32 extends beyond the side edges 34 of the bag 10, but the malleable wire 36 may be recessed relative to each end 38 of the closure strips 32. The length of the recess of the malleable wire 34 relative to the end 38 of the closure strip 32 may range from 0.05 to 1.5 inches, or 0.1 to 1.4 inches, or 0.15 to 1.2 inches, or 0.2 to 1.1 inches, or 0.3 to 1.0 inches, or 0.4 to 0.9 inches, or 0.5 to 0.8 inches. In one advantageous form, the malleable wire 34 is recessed by about 0.75 inches relative to the end 38 of the closure strip 34. In another form, the malleable wire 34 is not recessed relative to the length of the closure strip 32 and hence is substantially the same length as the closure strip 32. The malleable wire may be of a round, square, rectangular or triangular shape with a round shape being advantageous.

The exemplary metal detectable plastic bag 10 may also optionally include one or more pull tabs 40 affixed to the front wall 14, the back wall (not shown) or both the front wall 14 and the back wall of the bag 10. In one advantageous form, the one or more pull tabs 40 are located between the first closure strip 32 and the front wall 14, between the second closure strip (not shown) and the back wall (not shown), or a combination thereof. In one advantageous form, the bag 10 includes two pull tabs 40 with one pull tab affixed to the front wall 14 of the bag 10 and a second pull tab (not shown) is affixed to the rear wall (not shown) of the bag 10, wherein the two pull tabs 40 are opposite each other and are centered between the side edges 34 of the bag 10. In this orientation, the pull tabs 40 may more easily facilitate the opening of the mouth of the bag 10 for insertion of a product sample (not shown) into the internal collection space 15 by pulling the pull tabs 40 outward relative to the front wall 14 and rear wall (not shown) of the bag 10. After the product sample (not shown) is inserted into the internal collection space 15, the pull tabs 40 may then be used to facilitate the closing of the mouth of the bag 10 by pushing the pull tabs 40 inward relative to the front wall 14 and rear wall (not shown) of the bag 10. The bag 10 including a product sample (not shown) may then be securely closed by utilizing the bag closing mechanism by rolling from the top of the bag 10 from just below the bag opening mechanism 20 downward and then utilizing the closure strips 32 to secure the rolled down top of the bag 10 in the closed position.

The pull tabs 40 may be of any shape, including, but not limited to, square, rectangular, round, triangular and oval with a rectangular shape being advantageous. For a rectangular shaped pull tab, the overall length of the pull tab 40 may range from 0.5 to 3 inches, or 0.6 to 2.5 inches, or 0.7 to 2 inches, or 0.8 to 1.5 inches. For a rectangular shaped pull tab, the overall width of the pull tab 40 may range from 0.1 to 2 inches, or 0.2 to 1.5 inch, or 0.3 to 1 inch, or 0.4 to 0.75 inches.

The exemplary metal detectable plastic bag 10 may also optionally include an insignia for a "recommended fold line" (not shown) printed on the outside surface of a front wall 14 and/or rear wall (not shown) to provide an indication of the maximum fill depth for product within the bag 10 while still allowing for securing closing of the top portion of the bag 10. The optional "recommended fold line" marking may range from 1.5 to 6 inches, or 2 to 5 inches, or 2.3 to 4.5 inches, or 2.5 to 4.0 inches from the top edge 22 of the flexible body 12 of the bag 10.

The exemplary metal detectable plastic bag 10 includes a flexible body 12 that may be formed from a single layer or multi-layer polymeric film. The multi-layer polymeric film may include from one to six coextruded layers. Non-limiting exemplary polymers that may be used for the single layer or multi-layer polymeric film include low density polyethylene, linear low density polyethylene, high density polyethylene, polyester, polypropylene, ethylene vinyl acetate, polyamide, polylactic acid, metallized polyester, metallized polypropylene, metallized polyamide, metallized polyethylene, polyester from sugar cane or corn derived ethanol, and starch-based polymers. The thickness of the single layer or multi-layer polymeric film used to form the flexible body 12 of the plastic bag 10 may range from 0.5 to 20 mils, or 1.0 to 15 mils, or 1.5 to 10 mils, or 2.0 to 8 mils, or 2.25 to 7.5 mils, or 2.5 to 6 mils, or 2.75 to 5 mils, or 3 to 4 mils.

Alternatively, the exemplary metal detectable plastic bag 10 includes a flexible body 12 that may formed from a multi-layer lamination that includes from two to six polymeric films formed from either adhesive lamination, extrusion lamination or a combination thereof. Non-limiting exemplary polymeric films that may be used for the multilayer lamination include low density polyethylene, linear low density polyethylene, high density polyethylene, polyester, polypropylene, ethylene vinyl acetate, polyamide, polylactic acid, metallized polyester, metallized polypropylene, metallized polyamide, metallized polyethylene, polyester from sugar cane or corn derived ethanol, and starch-based polymers. The thickness of the multi-layer lamination used to form the flexible body 12 of the plastic bag 10 may range from 0.5 to 20 mils, or 1.0 to 15 mils, or 1.5 to 10 mils, or 2.0 to 8 mils, or 2.25 to 7.5 mils, or 2.5 to 6 mils, or 2.75 to 5 mils, or 3 to 4 mils.

In one advantageous form, the flexible body 12 of the bag 10 may be formed from low density polyethylene film or linear low density polyethylene film and has a thickness ranging from 2.25 to 3 mils.

The single or multi-layer polymeric film or multi-layer lamination used to form the flexible body 12 of the plastic bag 10 may be formed into a bag utilizing traditional bag forming processes and equipment. The top seal area 17, side seal areas 16 and bottom seal area 18 of the flexible body 12 of the bag 10 may be formed utilizing heat sealing, ultrasonic sealing or adhesive sealing technology. The top seal area 17, side seal areas 16 and bottom seal area 18 of the flexible body 12 of the bag 10 may range in width from 0.1 to 2 inches, or 0.15 to 1.5 inches, or 0.2 to 1.2 inches, or 0.3 to 1 inch, or 0.4 to 0.8 inches, or 0.5 to 0.7 inches.

The closure strips 32 of the optional bag closing mechanism 30 and the optional pull tabs 40 may be formed from single or multi-layer polymeric tapes or strips. Non-limiting exemplary materials that may be used to form the single or multi-layer polymeric tapes or strips include low density polyethylene, linear low density polyethylene, high density polyethylene, polyester, polypropylene, ethylene vinyl acetate, polyamide, polylactic acid, metallized polyester, metallized polypropylene, metallized polyamide, metallized polyethylene, polyester from sugar cane or corn derived ethanol, and starch-based polymers. In one advantageous form, the closure strips 32 and pull tabs 40 may be formed from high density polyethylene, low density polyethylene or linear low density polyethylene.

The closure strips 32 of the optional bag closing mechanism 30 and/or the optional pull tabs 40 may be optionally reverse printed, surface printed or surface coated. A reverse printed closure strip 32 and/or pull tab 40 provides for improved scuff resistance and prevention of removal from alcohol swabbing the bag 10. In another form, the closure strips 32 of the optional bag closing mechanism 30 and/or the optional pull tabs 40 may be optionally surface printed or surface coated with a metallic ink or a metallic coating to allow for the sample collection portion of the bag to be detected by a metal detector.

As discussed above, the removable tear strip 26 of the bag 10 includes a portion that is surface printed with a metallic based ink 28 or alternatively surface coated with a metallic based coating (not shown) to make the tear strip 26 detectable by a metal detector. Alternatively, at least a portion of the flexible body 12 below the removable tear strip may be surface printed with a metallic based ink or surface coated with a metallic based coating in order to make the flexible body 12 of the bag 10 detectable by a metal detector after removal of the tear strip 26.

The metallic based inks and metallic based coatings used for the various sections of the metal detectable bags disclosed herein include within the ink or coating system on a dry basis from 100 ppm to 10,000 ppm, or 200 to 8000 ppm, or 500 to 6000 ppm, or 750 to 5000 ppm, or 1000 to 4000 ppm, or 1500 to 3500 ppm, or 2000 to 3000 ppm of a metallic pigment powder. Non-limiting exemplary metallic pigments include aluminum, bronze, copper, nickel, cobalt, brass, copper-zinc alloys, zinc, iron based alloys and combinations thereof. The metallic based ink or the metallic based coating may be a solvent or water based system. Non-limiting exemplary metallic ink and metallic coating systems include acrylic, cellulosic, epoxy, urethane or polyvinylidene dichloride (PVDC) systems. The metallic ink or metallic coating may be applied to the removable tear strip 26 of the bag 10 and other portions of the bag 10 described above (closure strips 32, pull tabs 40, flexible body 12 utilizing traditional flexographic or rotogravure printing and coating processes. The metallized coating weight (dry basis) may range from 0.1 to 10 gram/meter$^2$, or from 0.2 to 8 gram/meter$^2$, or from 0.3 to 6 gram/meter$^2$, or from 0.4 to 4 gram/meter$^2$, or from 0.5 to 3 gram/meter$^2$, or from 0.6 to 2 gram/meter$^2$, or from 0.8 to 1.6 gram/meter$^2$, or from 1.0 to 1.4 gram/meter$^2$. The metallized ink density may range from 1.5 to 3.5, or 1.7 to 3.3, or 1.9 to 3.1, or 2.0 to 3.0, or 2.2 to 2.8, or 2.4 to 2.6 as measured by a reflection densitometer. In one advantageous form, the metallic based ink is blue in color and covers substantially the entire surface area of the removable tear strip 26 of the bag 10. Sun Chemicals and Magnum Coating and Inks are manufacturers and suppliers of such metallic inks and metallic coatings.

The closure strips 32 of the optional bag closing mechanism 30 may also optionally include a malleable wire 34 embedded within the closure strip 32. In an advantageous form as shown in FIG. 1, the malleable wire 34 is centered both top to bottom and side to side within the closure strip 32. Non-limiting exemplary materials that may be used for the malleable 34 include aluminum, bronze, copper, nickel, cobalt, brass, copper-zinc alloys, zinc, and iron based alloys. In one advantageous form, the malleable wire may be a galvanized steel to allow for ease of detection by a metal detector. The malleable wire 34 thickness may range from 5 gauge to 100 gauge, or 8 gauge to 90 gauge, or 10 gauge to 80 gauge, or 15 gauge to 70 gauge, or 20 gauge to 50 gauge, or 25 gauge to 40 gauge. In one advantageous form, the malleable wire is 25 gauge and is made from galvanized steel.

Film Forming and Lamination Forming Materials and Processes

Non-limiting exemplary materials used to form the multilayer lamination of the flexible body of the metal detectable bag disclosed herein include films of low density polyethylene, linear low density polyethylene, high density polyethylene, polyester, polypropylene, ethylene vinyl acetate, polyamide, aluminum foil, polylactic acid, metallized polyester, metallized polypropylene, metallized polyamide, metallized polyethylene, polyester from sugar cane or corn derived ethanol, paper and starch-based polymers and other similar film materials. The metal detectable bag may also be formed from, for instance, a monolayer film, a coextruded film, or a multilayer laminated film or a film in film type construction (i.e., structural film on outside and barrier film on inside) or any other suitable thin film material. A monolayer film may be formed from, for instance, a blown film or a cast film comprising of polypropylene, polyethylene, nylon, or any other suitable materials for use in a film. In alternate aspects, a monolayer film may be formed from any suitable material by any suitable means. The monolayer film may also have additives included for improved processing or physical characteristics of the resultant monolayer film. For example, monolayer films may also be formed with additives which modify transparency, feel, print quality, or barrier properties of the film, or any other suitable film characteristics which may be desirable.

The flexible body of the metal detectable bag may also be formed from a multi-layer lamination including one or more coextruded films. A coextruded film may be formed from blown film or a cast film and may further use combinations of resin types which are coextruded to form multiple layers. The film materials used to form a coextruded film may include low density polyethylene, linear low density polyethylene, high density polyethylene, polyester, polypropylene, ethylene vinyl acetate, polyamide, polylactic acid, polyester from sugar cane or corn derived ethanol, starch-based polymers, ethylene vinyl alcohol, or any other suitable film material. The film materials may be combined in multiple layers in any suitable configuration for desirable characteristics of the resultant coextruded film. A coextruded film may have any suitable number of layers. The bag may be formed from a laminated film. Laminated films may be comprised of a combination of co-extruded and/or mono-layer films similar to those discussed previously. A laminated film may be laminated by any suitable lamination technology, including, but not limited to, extrusion lamination, adhesive lamination, thermal bonding, and solvent or solventless lamination technologies. In alternate aspects, any suitable means of lamination of films may be used. The lamination configuration may be adjustable so that the resultant film may have desirable characteristics, for instance barrier properties, coefficient of friction, print layer characteristics, varnish, texture, and any other suitable characteristics desirable in a resultant film.

In an advantageous form, a multi-layer lamination is used form the flexible body of the bag, wherein the lamination is formed in an adhesive lamination process, an extrusion lamination process or a combination of adhesive and extrusion lamination process and includes from two to six films bonded together. The adhesive used in the adhesive lamination process may be an epoxy adhesive, a urethane adhesive, an acrylic adhesive, and a polyvinylidene dichloride adhesive. The multi-layer lamination may be sealed to itself to form the flexible body by an adhesive sealing process, an ultrasonic sealing process or a heat sealing process.

Method of Use of the Metal Detectable Plastic Bags Embodiments

The metal detectable plastic bags disclosed herein are useful as samples bags for various types of products, including, but not limited to, foods, pharmaceuticals, resins, solid additives, etc.

In one embodiment of the method of using a metal detectable plastic bag to collect and retain a product sample and eliminate product contamination comprises the steps of:

1) providing plastic bag comprising a plastic bag comprising a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, and wherein at least a portion of the removable tear strip is surface printed with a metallic based ink or surface coated with a metallic based coating;
2) removing the removable tear strip from the plastic bag; and
3) filling the internal collection space with a product sample; and wherein the removable tear strip is detectable by a metal detector on a product production and packaging line to prevent product contamination.

In another embodiment of the method of using a metal detectable plastic bag to collect and retain a product sample and eliminate product contamination comprises the steps of:

1) providing a plastic bag comprising a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, a bag closing mechanism located proximate and below the removable tear strip, wherein the bag closing mechanism includes a first closure strip sealed to the front wall of the bag and a second closure strip sealed to the back wall of the bag, wherein the first and second closure strips are opposed to each other and extend beyond the side edges of the bag and, wherein the first closure strip and the second closure strip include a malleable wire embedded in the closure strip that traverses substantially the entire length of the closure strip or that traverses a majority of the length of the closure strip, wherein the malleable wire is selected from the group consisting of aluminum, bronze, copper, nickel, cobalt, brass, copper-zinc alloys, zinc, and iron based alloys, and one or more pull tabs affixed to the front wall, the back wall or a combination, wherein the one or more pull tabs are located between the first closure strip and the front wall, between the second closure strip and the back wall, or a combination thereof, and wherein at least a portion of the removable tear strip is surface printed with a metallic based ink or surface coated with a metallic based coating;
2) removing the removable tear strip from the plastic bag;
3) filling the internal collection space with a product sample; and
4) closing the bag including the product sample with the bag closing mechanism; and wherein the removable tear strip is detectable by a metal detector on a product production and packaging line to prevent product contamination.

The metal detectable plastic bags disclosed herein may be detectable by both active and passive metal detectors, which are commonly used in manufacturing operations to prevent metal contaminants from getting into product stream and packaged products.

Other Embodiments

A1. A metal detectable bag comprising: a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, and wherein at least a portion of the removable tear strip is surface printed with a metallic based ink or surface coated with a metallic based coating.

A2. The bag of paragraph A1, wherein at least a portion of the flexible body below the removable tear strip is surface printed with a metallic based ink or surface coated with a metallic based coating.

A3. The bag of paragraph A1 or A2, wherein the metallic based ink or the metallic based coating includes from 100 ppm to 10,000 ppm of a metallic pigment powder selected from the group consisting of aluminum, bronze, copper, nickel, cobalt, brass, copper-zinc alloys, zinc, iron based alloys and combinations thereof.

A4. The bag of paragraph A1 (or A2-A3), wherein the metallic based ink or the metallic based coating comprises a solvent or water based acrylic, cellulosic, epoxy, urethane or polyvinylidene dichloride (PVDC) system.

A5. The bag of paragraph A1 (or A2-A4), wherein the metallic based ink is blue in color and covers substantially the entire surface area of the removable tear strip.

A6. The bag of paragraph A1 (or A2-A5), wherein the metallic based ink is printed on the removable tear strip at a density of at least 1.5 as measured by a reflection densitometer.

A7. The bag of paragraph A6, wherein the removable tear strip provides improved grip and higher coefficient of friction for ease of gripping and removing the tear strip compared to a comparable bag with a metallic based ink printed on the removable tear strip at a density of less than 1.4.

A8. The bag of paragraph A1 (or A2-A7), wherein the one or more perforations, scores or cuts in the one or two side seal areas and optionally the front and back wall comprise a line of perforations, scores or cuts that traverse across substantially the entire width of the bag.

A9. The bag of paragraph A1 (or A2-A8), wherein the two side seal areas, the top seal area and the bottom seal area are heat seals, adhesive seals or ultrasonic seals.

A10. The bag of paragraph A1 (or A2-A9) further comprising a bag closing mechanism located proximate and below the removable tear strip, wherein the bag closing mechanism includes a first closure strip sealed to the front wall of the bag and a second closure strip sealed to the back wall of the bag, wherein the first and second closure strips are opposed to each other and extend beyond the side edges of the bag.

A11. The bag of paragraph A10, wherein the first closure strip, the second closure strip or a combination thereof further include a malleable wire embedded in the closure strip that traverses substantially the entire length of the closure strip or that traverses a majority of the length of the closure strip, wherein the malleable wire is selected from the group consisting of aluminum, bronze, copper, nickel, cobalt, brass, copper-zinc alloys, zinc, and iron based alloys.

A12. The bag of paragraph A11, wherein the malleable wire is an iron based alloy, and wherein the bag after removal of the removal tear strip is detectable by a metal detector.

A13. The bag of paragraph A11 or A12, wherein the malleable wire is recessed relative to the two ends of the first closure strip and the two ends of the second closure strip.

A14. The bag of paragraph A10 (or A11-A13), wherein the first and second closure strips extending beyond the side edges of the bag are not sealed together beyond the side edges of the bag, are sealed together beyond the side edges of the bag, or a combination thereof.

A15. The bag of paragraph A10 (or A11-A14), wherein the first closure strip sealed to the front wall of the bag and the second closure strip sealed to the back wall of the bag are heat seals, adhesive seals, ultrasonic seals or a combination thereof.

A16. The bag of paragraph A10 (or A11-A15), wherein the first closure strip, the second closure strip or a combination thereof are surface or reverse printed or surface or reverse coated prior to sealing to the walls of the bag.

A17. The bag of paragraph A14 (or A15-A16), wherein the surface printed or surface coated first and second closure strip include a metallic based ink or a metallic based coating.

A18. The bag of paragraph A17, wherein the metallic based ink or the metallic based coating includes from 100 ppm to 10,000 ppm of a metallic pigment powder selected from the group consisting of aluminum, bronze, copper, nickel, cobalt, brass, copper-zinc alloys, zinc, iron based alloys and combinations thereof.

A19. The bag of paragraph A17 or A18, wherein the metallic based ink or the metallic based coating comprises a solvent or water based acrylic, cellulosic, epoxy, urethane or polyvinylidene dichloride (PVDC) system.

A20. The bag of paragraph A19 (or A17-A18), wherein the metallic based ink is yellow in color and covers substantially the entire surface area of the first and second closure strip.

A21. The bag of paragraph A10 (or A11-A20) further comprising one or more pull tabs affixed to the front wall, the back wall or a combination thereof.

A22. The bag of paragraph A21, wherein the one or more pull tabs are located between the first closure strip and the front wall, between the second closure strip and the back wall, or a combination thereof.

A23. The bag of paragraph A22, wherein a first pull tab is located about midway between the two side edges of the bag between the first closure strip and the front wall of the bag and a second pull tab is located about midway between the two side edges of the bag between the second closure strip and the back wall, and wherein the first pull tab and the second pull tab are opposite each other.

A24. The bag of A1 (or A2-A23), wherein the single or multi-layer polymeric film includes from one to six layers selected from the group consisting of low density polyethylene, linear low density polyethylene, high density polyethylene, polyester, polypropylene, ethylene vinyl acetate, polyamide, polylactic acid, metallized polyester, metallized polypropylene, metallized polyamide, metallized polyethylene, polyester from sugar cane or corn derived ethanol, and starch-based polymers.

A25. The bag of A1 (or A2-A24), wherein the multi-layer lamination includes from two to six polymeric films is an adhesive lamination, an extrusion lamination or combination thereof.

A26. The bag of A1 (or A2-A25), wherein the two to six polymer films are selected from the group consisting of low density polyethylene, linear low density polyethylene, high density polyethylene, polyester, polypropylene, ethylene vinyl acetate, polyamide, polylactic acid, metallized polyester, metallized polypropylene, metallized polyamide, metallized polyethylene, polyester from sugar cane or corn derived ethanol, and starch-based polymers.

A27. The bag of A10 (or A11-A26), wherein the first closure strip and the second closure strip are formed from single or multi-layer polymeric tapes or strips including from one to six layers selected from the group consisting of low density polyethylene, linear low density polyethylene, high density polyethylene, polyester, polypropylene, ethylene vinyl acetate, polyamide, polylactic acid, metallized polyester, metallized polypropylene, metallized polyamide, metallized polyethylene, polyester from sugar cane or corn derived ethanol, and starch-based polymers.

A28. The bag of paragraph A21 (or A22-A27), wherein one or more pull tabs are formed from single or multi-layer polymeric tapes or strips including from one to six layers selected from the group consisting of low density polyethylene, linear low density polyethylene, high density polyethylene, polyester, polypropylene, ethylene vinyl acetate, polyamide, polylactic acid, metallized polyester, metallized polypropylene, metallized polyamide, metallized polyethylene, polyester from sugar cane or corn derived ethanol, and starch-based polymers.

B1. A metal detectable plastic bag comprising: a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, a bag closing mechanism located proximate and below the removable tear strip, wherein the bag closing mechanism includes a first closure strip sealed to the front wall of the bag and a second closure strip sealed to the back wall of the bag, wherein the first and second closure strips are opposed to each other and extend beyond the side edges of the bag and, wherein the first closure strip and the second closure strip include a malleable wire embedded in the closure strip that traverses substantially the entire length of the closure strip or that traverses a majority of the length of the closure strip, wherein the malleable wire is selected from the group consisting of aluminum, bronze, copper, nickel, cobalt, brass, copper-zinc alloys, zinc, and iron based alloys, and one or more pull tabs affixed to the front wall, the back wall or a combination, wherein the one or more pull tabs are located between the first closure strip and the front wall, between the second closure strip and the back wall, or a combination thereof, and wherein at least a portion of the removable tear strip is surface printed with a metallic based ink or surface coated with a metallic based coating.

B2. The bag of paragraph B1, wherein at least a portion of the flexible body below the removable tear strip is surface printed with a metallic based ink or surface coated with a metallic based coating.

B3. The bag of paragraph B1 or B2, wherein the metallic based ink or the metallic based coating includes from 100 ppm to 10,000 ppm of a metallic pigment powder selected from the group consisting of aluminum, bronze, copper, nickel, cobalt, brass, copper-zinc alloys, zinc, iron based alloys and combinations thereof.

B4. The bag of paragraph B1 (or B2-B3), wherein the metallic based ink or the metallic based coating comprises a solvent or water based acrylic, cellulosic, epoxy, urethane or polyvinylidene dichloride (PVDC) system.

B5. The bag of paragraph B1 (or B2-B4), wherein the metallic based ink is blue in color and covers substantially the entire surface area of the removable tear strip.

B6. The bag of paragraph B1 (or B2-B5), wherein the metallic based ink is printed on the removable tear strip at a density of at least 1.5 as measured by a reflection densitometer.

B7. The bag of paragraph B6, wherein the removable tear strip provides improved grip and higher coefficient of friction for ease of gripping and removing the tear strip compared to a comparable bag with a metallic based ink printed on the removable tear strip at a density of less than 1.4.

B8. The bag of paragraph B1 (or B2-B7), wherein the one or more perforations, scores or cuts in the one or two side seal areas and optionally the front and back wall comprise a line of perforations, scores or cuts that traverse across substantially the entire width of the bag.

B9. The bag of paragraph B1 (or B2-B8), wherein the malleable wire is an iron based alloy, and wherein the bag after removal of the removal tear strip is detectable by a metal detector.

B10. The bag of paragraph B1 (or B2-B9), wherein the malleable wire is recessed relative to the two ends of the first closure strip and the two ends of the second closure strip.

B11. The bag of paragraph B1 (or B2-B10), wherein the first and second closure strips extending beyond the side edges of the bag are not sealed together beyond the side edges of the bag, are sealed together beyond the side edges of the bag, or a combination thereof.

C1. A method of making a metal detectable plastic bag comprising: providing a plastic bag comprising a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, and surface printing or coating on at least a portion of the removable tear strip of the plastic bag a metallic based ink or a metallic based coating.

D1. A method of making a metal detectable plastic bag comprising: providing a plastic bag comprising a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, a bag closing mechanism located proximate and below the removable tear strip, wherein the bag closing mechanism includes a first closure strip sealed to the front wall of the bag and a second closure strip sealed to the back wall of the bag, wherein the first and second closure strips are opposed to each other and extend beyond the side edges of the bag and, wherein the first closure strip and the second closure strip include a malleable wire embedded in the closure strip that traverses substantially the entire length of the closure strip or that traverses a majority of the length of the closure strip, wherein the malleable wire is selected from the group consisting of aluminum, bronze, copper, nickel, cobalt, brass, copper-zinc alloys, zinc, and iron based alloys, and one or more pull tabs affixed to the front wall, the back wall or a combination, wherein the one or more pull tabs are located between the first closure strip and the front wall, between the second closure strip and the back wall, or a combination thereof, and surface printing or coating on at least a portion of the removable tear strip of the plastic bag a metallic based ink or a metallic based coating.

E1. A method of using a metal detectable plastic bag to collect and retain a product sample and eliminate product contamination comprising: providing plastic bag comprising a plastic bag comprising a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, and wherein at least a portion of the removable tear strip is surface printed with a metallic based ink or surface coated with a metallic based coating; removing the removable tear strip from the plastic bag; and filling the internal collection space with a product sample; and wherein the removable tear strip is detectable by a metal detector on a product production and packaging line to prevent product contamination.

F1. A method of using a metal detectable plastic bag to collect and retain a product sample and eliminate product contamination comprising: providing a plastic bag comprising a flexible body formed from a single or multi-layer polymeric film or multi-layer lamination including an opposed front wall and back wall sealed together around the periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two side seal areas and optionally the front and back wall to form a removable tear strip, a bag closing mechanism located proximate and below the removable tear strip, wherein the bag closing mechanism includes a first closure strip sealed to the front wall of the bag and a second closure strip sealed to the back wall of the bag, wherein the first and second closure strips are opposed to each other and extend beyond the side edges of the bag and, wherein the first closure strip and the second closure strip include a malleable wire embedded in the closure strip that traverses substantially the entire length of the closure strip or that traverses a majority of the length of the closure strip, wherein the malleable wire is selected from the group consisting of aluminum, bronze, copper, nickel, cobalt, brass, copper-zinc alloys, zinc, and iron based alloys, and one or more pull tabs affixed to the front wall, the back wall or a combination, wherein the one or more pull tabs are located between the first closure strip and the front wall, between the second closure strip and the back wall, or a combination thereof, and wherein at least a portion of the removable tear strip is surface printed with a metallic based ink or surface coated with a metallic based coating; removing the removable tear strip from the plastic bag; filling the internal collection space with a product sample; and closing the bag including the product sample with the bag closing mechanism; and wherein the removable tear strip is detectable by a metal detector on a product production and packaging line to prevent product contamination.

It should be understood that the foregoing description is only illustrative of the aspects of the disclosed embodiment and that the aspects of the disclosed embodiment can be used individually or in any suitable combination thereof. Various alternatives and modifications can be devised by those skilled in the art without departing from the aspects of the disclosed embodiment. Accordingly, the aspects of the disclosed embodiment are intended to embrace all such alternatives, modifications and variances that fall within the scope of the appended claims. Further, the mere fact that different features are recited in mutually different dependent or independent claims does not indicate that a combination of these features cannot be advantageously used, such a combination remaining within the scope of the aspects of the invention.

All patents, test procedures, and other documents cited herein, including priority documents, are fully incorporated by reference to the extent such disclosure is not inconsistent with this invention and for all jurisdictions in which such incorporation is permitted. When numerical lower limits and numerical upper limits are listed herein, ranges from any lower limit to any upper limit are contemplated.

Those skilled in the art will recognize, or be able to ascertain using no more than routine experimentation, many equivalents to the specific embodiments and methods described herein. Such equivalents are intended to be encompassed by the scope of the following claims.

What is claimed is:

1. A metal detectable plastic bag comprising:

a flexible body formed from a single or multi-layer polymeric film or multi-layer lamination including an opposed front wall and back wall sealed together around a periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in one or two side seal areas and the front and back wall to form a removable tear strip, and wherein at least a portion of the removable tear strip is surface printed with a metallic based ink or surface coated with a metallic based coating, and wherein the metallic based ink or the metallic based coating includes from 100 ppm to 10,000 ppm of a metallic pigment powder selected from the group consisting of aluminum, bronze, copper, nickel, cobalt, brass, copper-zinc alloys, zinc, iron based alloys and combinations thereof.

2. The bag of claim 1, wherein at least a portion of the flexible body below the removable tear strip is surface printed with a metallic based ink or surface coated with a metallic based coating.

3. The bag of claim 1 wherein the metallic based ink or the metallic based coating comprises a solvent or water based acrylic, cellulosic, epoxy, urethane or polyvinylidene dichloride (PVDC) system.

4. The bag of claim 1, wherein the metallic based ink is blue in color and covers substantially an entire surface area of the removable tear strip.

5. The bag of claim 1, wherein the metallic based ink is printed on the removable tear strip at a density of at least 1.5 as measured by a reflection densitometer.

6. The bag of claim 5, wherein the removable tear strip provides improved grip and higher coefficient of friction for ease of gripping and removing the tear strip.

7. The bag of claim 1, wherein the one or more perforations, scores or cuts in the one or two of the two side seal areas and the front and back wall comprise a line of perforations, scores or cuts that traverse across substantially an entire width of the bag.

8. The bag of claim 1, wherein the two side seal areas, the top seal area and the bottom seal area are heat seals, adhesive seals or ultrasonic seals.

9. The bag of claim 1 further comprising a bag closing mechanism located proximate and below the removable tear strip, wherein the bag closing mechanism includes a first closure strip sealed to the front wall of the bag and a second closure strip sealed to the back wall of the bag, wherein the first and second closure strips are opposed to each other and extend beyond side edges of the bag.

10. The bag of claim 9, wherein the first closure strip, the second closure strip or a combination thereof further include a malleable wire embedded in the closure strip that traverses substantially an entire length of the closure strip or that traverses a majority of a length of the closure strip, wherein the malleable wire is selected from the group consisting of aluminum, bronze, copper, nickel, cobalt, brass, copper-zinc alloys, zinc, and iron based alloys.

11. The bag of claim 10, wherein the malleable wire is an iron based alloy, and wherein the bag after removal of the removal tear strip is detectable by a metal detector.

12. The bag of claim 10, wherein the malleable wire is recessed relative to two ends of the first closure strip and two ends of the second closure strip.

13. The bag of claim 9 wherein the first and second closure strips extending beyond the side edges of the bag are not sealed together beyond the side edges of the bag, are sealed together beyond the side edges of the bag, or a combination thereof.

14. The bag of claim 9, wherein the first closure strip sealed to the front wall of the bag and the second closure strip sealed to the back wall of the bag are heat seals, adhesive seals, ultrasonic seals or a combination thereof.

15. The bag of claim 9, wherein the first closure strip, the second closure strip or a combination thereof are surface or reverse printed or surface or reverse coated prior to sealing to the walls of the bag.

16. The bag of claim 15, wherein the surface printed or surface coated first and second closure strip include a metallic based ink or a metallic based coating.

17. The bag of claim 16, wherein the metallic based ink or the metallic based coating includes from 100 ppm to 10,000 ppm of a metallic pigment powder selected from the group consisting of aluminum, bronze, copper, nickel, cobalt, brass, copper-zinc alloys, zinc, iron based alloys and combinations thereof.

18. The bag of claim 17 wherein the metallic based ink or the metallic based coating comprises a solvent or water based acrylic, cellulosic, epoxy, urethane or polyvinylidene dichloride (PVDC) system.

19. The bag of claim 18, wherein the metallic based ink is yellow in color and covers substantially an entire surface area of the first and second closure strip.

20. The bag of claim 9 further comprising one or more pull tabs affixed to the front wall, the back wall or a combination thereof.

21. The bag of claim 20, wherein the one or more pull tabs are located between the first closure strip and the front wall, between the second closure strip and the back wall, or a combination thereof.

22. The bag of claim 21, wherein a first pull tab of the one or more pull tabs is located about midway between the two side edges of the bag between the first closure strip and the front wall of the bag and a second pull tab of the one or more pull tabs is located about midway between the two side edges of the bag between the second closure strip and the back wall, and wherein the first pull tab and the second pull tab are opposite each other.

23. The bag of claim 20, wherein one or more pull tabs are formed from single or multi-layer polymeric tapes or strips including from one to six layers selected from the group consisting of low density polyethylene, linear low density polyethylene, high density polyethylene, polyester, polypropylene, ethylene vinyl acetate, polyamide, polylactic acid, metallized polyester, metallized polypropylene, metallized polyamide, metallized polyethylene, polyester from sugar cane or corn derived ethanol, and starch-based polymers.

24. The bag of claim 9, wherein the first closure strip and the second closure strip are formed from single or multi-layer polymeric tapes or strips including from one to six layers selected from the group consisting of low density polyethylene, linear low density polyethylene, high density polyethylene, polyester, polypropylene, ethylene vinyl acetate, polyamide, polylactic acid, metallized polyester, metallized polypropylene, metallized polyamide, metallized polyethylene, polyester from sugar cane or corn derived ethanol, and starch-based polymers.

25. The bag of claim 1, wherein the single or multi-layer polymeric film includes from one to six layers selected from the group consisting of low density polyethylene, linear low density polyethylene, high density polyethylene, polyester, polypropylene, ethylene vinyl acetate, polyamide, polylactic acid, metallized polyester, metallized polypropylene, metallized polyamide, metallized polyethylene, polyester from sugar cane or corn derived ethanol, and starch-based polymers.

26. The bag of claim 1, wherein the multi-layer lamination includes from two to six polymeric films is an adhesive lamination, an extrusion lamination or combination thereof.

27. The bag of claim 26, wherein the two to six polymer films are selected from the group consisting of low density polyethylene, linear low density polyethylene, high density polyethylene, polyester, polypropylene, ethylene vinyl acetate, polyamide, polylactic acid, metallized polyester, metallized polypropylene, metallized polyamide, metallized polyethylene, polyester from sugar cane or corn derived ethanol, and starch-based polymers.

28. A metal detectable plastic bag comprising:

a flexible body formed from a single or multi-layer polymeric film or multi-layer lamination including an opposed front wall and back wall sealed together around a periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two of the two side seal areas and the front and back wall to form a removable tear strip, a bag closing mechanism located proximate and below the removable tear strip, wherein the bag closing mechanism includes a first closure strip sealed to the front wall of the bag and a second closure strip sealed to the back wall of the bag, wherein the first and second closure strips are opposed to each other and extend beyond side edges of the bag and, wherein the first closure strip and the second closure strip include a malleable wire embedded in the closure strip that traverses substantially an entire length of the closure strip or that traverses a majority of a length of the closure strip, wherein the malleable wire is selected from the group consisting of aluminum, bronze, copper, nickel, cobalt, brass, copper-zinc alloys, zinc, and iron based alloys, and one or more pull tabs affixed to the front wall, the back wall or a combination, wherein the one or more pull tabs are located between the first closure strip and the front wall, between the second closure strip and the back wall, or a combination thereof, and wherein at least a portion of the removable tear strip is surface printed with a metallic based ink or surface coated with a metallic based coating, and wherein the metallic based ink or the metallic based coating includes from 100 ppm to 10,000 ppm of a metallic pigment powder selected from the group consisting of aluminum, bronze, copper, nickel, cobalt, brass, copper-zinc alloys, zinc, iron based alloys and combinations thereof.

29. The bag of claim 28, wherein at least a portion of the flexible body below the removable tear strip is surface printed with a metallic based ink or surface coated with a metallic based coating.

30. The bag of claim 28 wherein the metallic based ink or the metallic based coating comprises a solvent or water based acrylic, cellulosic, epoxy, urethane or polyvinylidene dichloride (PVDC) system.

31. The bag of claim 28, wherein the metallic based ink is blue in color and covers substantially an entire surface area of the removable tear strip.

32. The bag of claim 28, wherein the metallic based ink is printed on the removable tear strip at a density of at least 1.5 as measured by a reflection densitometer.

33. The bag of claim 32, wherein the removable tear strip provides improved grip and higher coefficient of friction for ease of gripping and removing the tear strip.

34. The bag of claim 28, wherein the one or more perforations, scores or cuts in the one or two of the two side seal areas and the front and back wall comprise a line of perforations, scores or cuts that traverse across substantially an entire width of the bag.

35. The bag of claim 28, wherein the malleable wire is an iron based alloy, and wherein the bag after removal of the removal tear strip is detectable by a metal detector.

36. The bag of claim 28, wherein the malleable wire is recessed relative to two ends of the first closure strip and two ends of the second closure strip.

37. The bag of claim 28 wherein the first and second closure strips extending beyond the side edges of the bag are not sealed together beyond the side edges of the bag, are sealed together beyond the side edges of the bag, or a combination thereof.

38. A method of making a metal detectable plastic bag comprising:

providing a plastic bag comprising a flexible body formed from a single or multi-layer polymeric film or multi-layer lamination including an opposed front wall and back wall sealed together around a periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two of the two side seal areas and the front and back wall to form a removable tear strip, and surface printing or coating on at least a portion of the removable tear strip of the plastic bag a metallic based ink or a metallic based coating, and wherein the metallic based ink or the metallic based coating includes from 100 ppm to 10,000 ppm of a metallic pigment powder selected from the group consisting of aluminum, bronze, copper, nickel, cobalt, brass, copper-zinc alloys, zinc, iron based alloys and combinations thereof.

39. A method of making a metal detectable plastic bag comprising:

providing a plastic bag comprising a flexible body formed from a single or multi-layer polymeric film or multi-layer lamination including an opposed front wall and back wall sealed together around a periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two of the two side seal areas and the front and back wall to form a removable tear strip, a bag closing mechanism located proximate and below the removable tear strip, wherein the bag closing mechanism includes a first closure strip sealed to the front wall of the bag and a second closure strip sealed to the back wall of the bag, wherein the first and second closure strips are opposed to each other and extend beyond side edges of the bag and, wherein the first closure strip and the second closure strip include a malleable wire embedded in the closure strip that traverses substantially an entire length of the closure strip or that traverses a majority of a length of the closure strip, wherein the malleable wire is selected from the group consisting of aluminum, bronze, copper, nickel, cobalt, brass, copper-zinc alloys, zinc, and iron based alloys, and one or more pull tabs affixed to the front wall, the back wall or a combination, wherein the one or more pull tabs are located between the first closure strip and the front wall, between the second closure strip and the back wall, or a combination thereof, and surface printing or coating on at least a portion of the removable tear strip of the plastic bag a metallic based ink or a metallic based coating, and wherein the metallic based ink or the metallic based coating includes from 100 ppm to 10,000 ppm of a metallic pigment powder selected from the group consisting of aluminum, bronze, copper, nickel, cobalt, brass, copper-zinc alloys, zinc, iron based alloys and combinations thereof.

40. A method of using a metal detectable plastic bag to collect and retain a product sample and eliminate product contamination comprising:

providing plastic bag comprising a plastic bag comprising a flexible body formed from a single or multi-layer polymeric film or multi-layer lamination including an opposed front wall and back wall sealed together around a periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two of the two side seal areas and the front and back wall to form a removable tear strip, and wherein at least a portion of the removable tear strip is surface printed with a metallic based ink or surface coated with a metallic based coating; and wherein the metallic based ink or the metallic based coating includes from 100 ppm to 10,000 ppm of a metallic pigment powder selected from the group consisting of aluminum, bronze, copper, nickel, cobalt, brass, copper-zinc alloys, zinc, iron based alloys and combinations thereof;

removing the removable tear strip from the plastic bag; and filling the internal collection space with a product sample; and wherein the removable tear strip is detectable by a metal detector on a product production and packaging line to prevent product contamination.

41. A method of using a metal detectable plastic bag to collect and retain a product sample and eliminate product contamination comprising:

providing a plastic bag comprising a flexible body formed from a single or multi-layer polymeric film or multi-layer lamination including an opposed front wall and back wall sealed together around a periphery of the front wall and the back wall to form an internal collection space including two side seal areas, a top seal area and a bottom seal area, and a bag opening mechanism located proximate a top edge of the flexible body and below the top seal area, wherein the bag opening mechanism includes one or more perforations, scores or cuts in the one or two of the two side seal areas and the front and back wall to form a removable tear strip, a bag closing mechanism located proximate and below the removable tear strip, wherein the bag closing mechanism includes a first closure strip sealed to the front wall of the bag and a second closure strip sealed to the back wall of the bag, wherein the first and second closure strips are opposed to each other and extend beyond side edges of the bag and, wherein the first closure strip and the second closure strip include a malleable wire embedded in the closure strip that traverses substantially an entire length of the closure strip or that traverses a majority of a length of the closure strip, wherein the malleable wire is selected from the group consisting of aluminum, bronze, copper, nickel, cobalt, brass, copper-zinc alloys, zinc, and iron based alloys, and one or more pull tabs affixed to the front wall, the back wall or a combination, wherein the one or more pull tabs are located between the first closure strip and the front wall, between the second closure strip and the back wall, or a combination thereof, and wherein at least a portion of the removable tear strip is surface printed with a metallic based ink or surface coated with a metallic based coating; and wherein the metallic based ink or the metallic based coating includes from 100 ppm to 10,000 ppm of a metallic pigment powder selected from the group consisting of aluminum, bronze, copper, nickel, cobalt, brass, copper-zinc alloys, zinc, iron based alloys and combinations thereof;

removing the removable tear strip from the plastic bag;

filling the internal collection space with a product sample; and closing the bag including the product sample with the bag closing mechanism; and wherein the removable tear strip is detectable by a metal detector on a product production and packaging line to prevent product contamination.

* * * * *